US012005284B2

(12) United States Patent
Starke

(10) Patent No.: US 12,005,284 B2
(45) Date of Patent: Jun. 11, 2024

(54) PHYSICAL THERAPY ASSEMBLY

(71) Applicant: Robert Starke, Troy, MO (US)

(72) Inventor: Robert Starke, Troy, MO (US)

( * ) Notice: Subject to any disclaimer, the term of this patent is extended or adjusted under 35 U.S.C. 154(b) by 90 days.

(21) Appl. No.: 17/831,780

(22) Filed: Jun. 3, 2022

(65) Prior Publication Data

US 2023/0390597 A1 Dec. 7, 2023

(51) Int. Cl.
*A63B 21/00* (2006.01)
*A63B 23/04* (2006.01)
*A63B 23/12* (2006.01)

(52) U.S. Cl.
CPC .... *A63B 21/00047* (2013.01); *A63B 21/4035* (2015.10); *A63B 21/4037* (2015.10); *A63B 23/1209* (2013.01); *A63B 2023/0411* (2013.01); *A63B 2208/0204* (2013.01)

(58) Field of Classification Search
CPC ..... A63B 21/00047; A63B 21/4033; A63B 21/4035; A63B 21/4037; A63B 22/02
See application file for complete search history.

(56) References Cited

U.S. PATENT DOCUMENTS 1,082,940 A * 12/1913 Flora ..... A63B 22/02 482/54
4,834,364 A 5/1989 Gongwer
4,923,194 A 5/1990 Montgomery
5,158,520 A * 10/1992 Lemke ..... A63B 21/06 482/133
5,526,541 A 6/1996 Massey
7,563,215 B1 * 7/2009 Ross, Jr. ..... A63B 21/00047 482/148
D667,904 S 9/2012 DeFrancisci
8,961,375 B2 * 2/2015 Henesey ..... A63B 21/065 482/142
11,559,454 B2 * 1/2023 Esworthy ..... A61G 7/1076
2004/0043877 A1 3/2004 Brown
2005/0059536 A1 * 3/2005 Croft ..... A63B 21/023 482/142
2006/0003877 A1 1/2006 Harmon
2020/0114190 A1 * 4/2020 Tuller ..... A63B 17/00
2022/0040519 A1 * 2/2022 Do ..... A63B 23/1236
2022/0387840 A1 * 12/2022 Ivanov ..... A63B 69/215

FOREIGN PATENT DOCUMENTS

WO WO9320899 10/1993

* cited by examiner

*Primary Examiner* — Zachary T Moore

(57) ABSTRACT

A physical therapy assembly includes a platform that is positionable on a horizontal support surface thereby facilitating a user to stand on the platform. A support bracket is removably attachable to the platform and the support bracket has a grip that is integrated into the support bracket. The support bracket extends upwardly from the platform having the grip being spaced from the platform thereby facilitating the grip to be gripped by the user when the user stands on the mat. The support bracket is oriented to angle rearwardly on the platform thereby facilitating the user to perform assisted squats when the user grips the grip. In this way the support bracket facilitates the user to perform physical therapy exercises.

4 Claims, 6 Drawing Sheets

PHYSICAL THERAPY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to therapy devices and more particularly pertains to a new therapy device for facilitating a user to perform assisted physical therapy exercises.

(2) Description of Related Art Including Information Disclosed Under 37 CFR 1.97 and 1.98

The prior art relates to therapy devices including an exercise device that includes a vertical stand, handles on the stand for gripping and food pegs on the stand for standing on the foot pegs. The prior art discloses a push-up exercise device that includes a cross bar extending between a pair of inclined bars. The prior art discloses a patient transfer stand that includes a cart with a frame and a set of restraints that are extendable around a patient to secure the patient in a standing position on the cart. The prior art discloses a squat platform device that includes a platform, a hole in the platform, a frame surrounding the platform and a waist belt for wearing around a patient's waist. The prior art discloses an exercise apparatus that includes a platform and a waist frame that surrounds a waist of a user standing on the platform.

BRIEF SUMMARY OF THE INVENTION

An embodiment of the disclosure meets the needs presented above by generally comprising a platform that is positionable on a horizontal support surface thereby facilitating a user to stand on the platform. A support bracket is removably attachable to the platform and the support bracket has a grip that is integrated into the support bracket. The support bracket extends upwardly from the platform having the grip being spaced from the platform thereby facilitating the grip to be gripped by the user when the user stands on the mat. The support bracket is oriented to angle rearwardly on the platform thereby facilitating the user to perform assisted squats when the user grips the grip. In this way the support bracket facilitates the user to perform physical therapy exercises.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
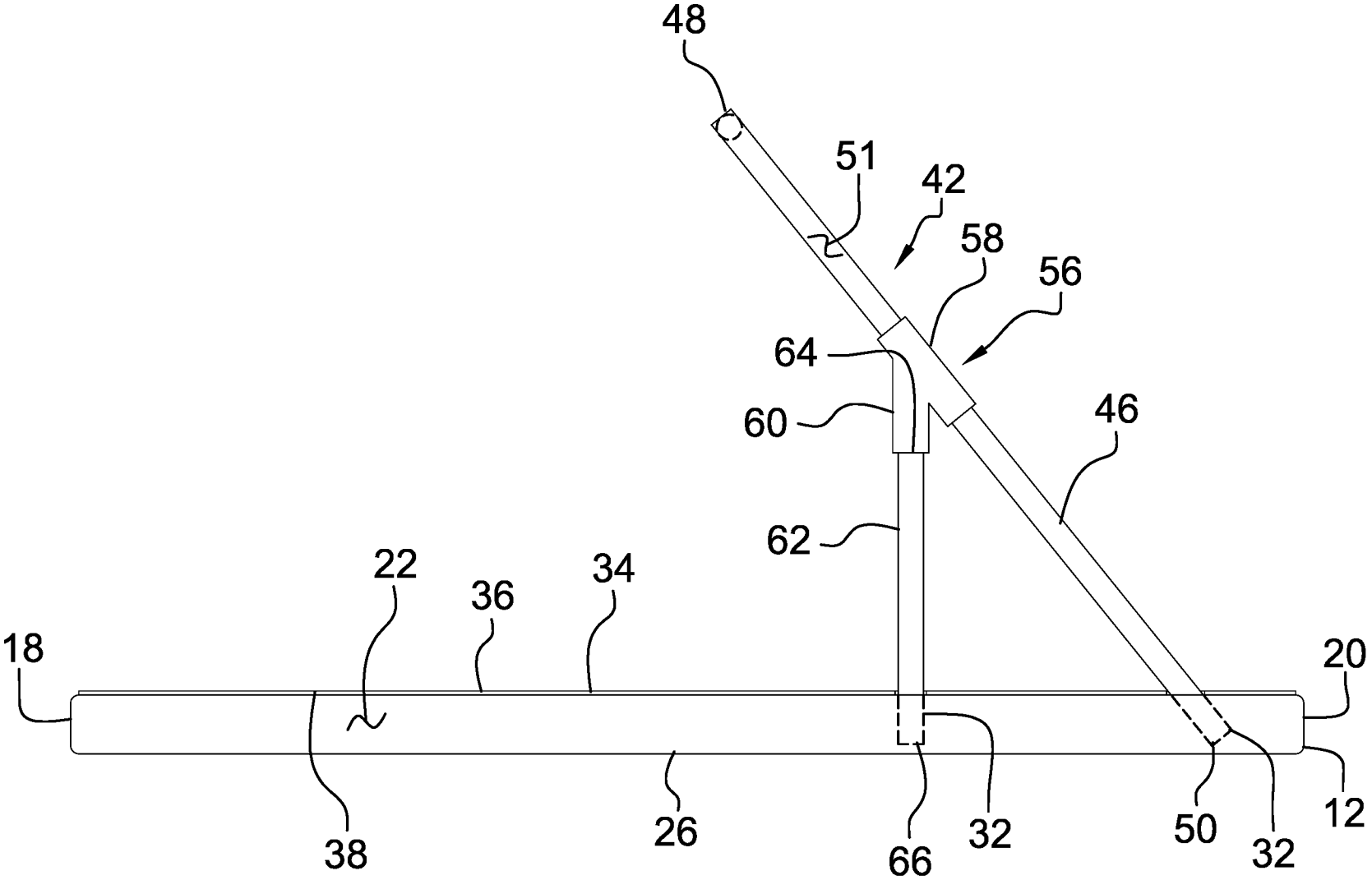
FIG. 1 is a right side phantom view of a physical therapy assembly according to an embodiment of the disclosure.
Figure 3:
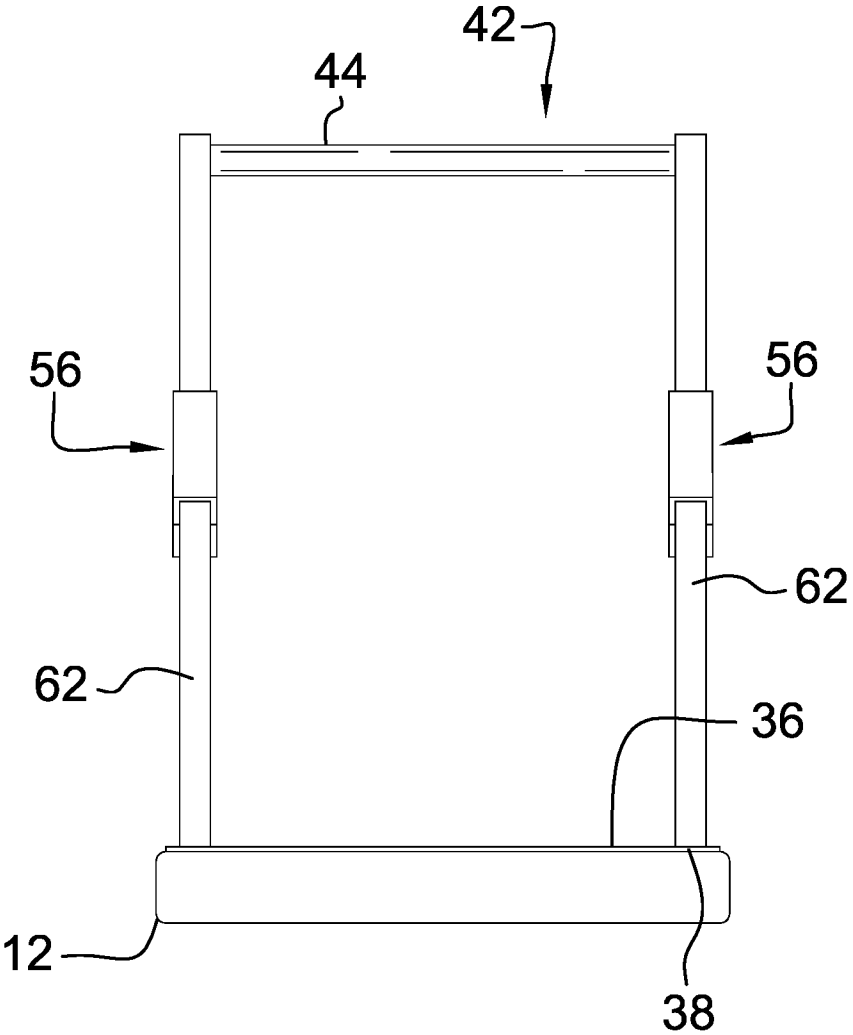
FIG. 3 is a back view of an embodiment of the disclosure.
Figure 2:
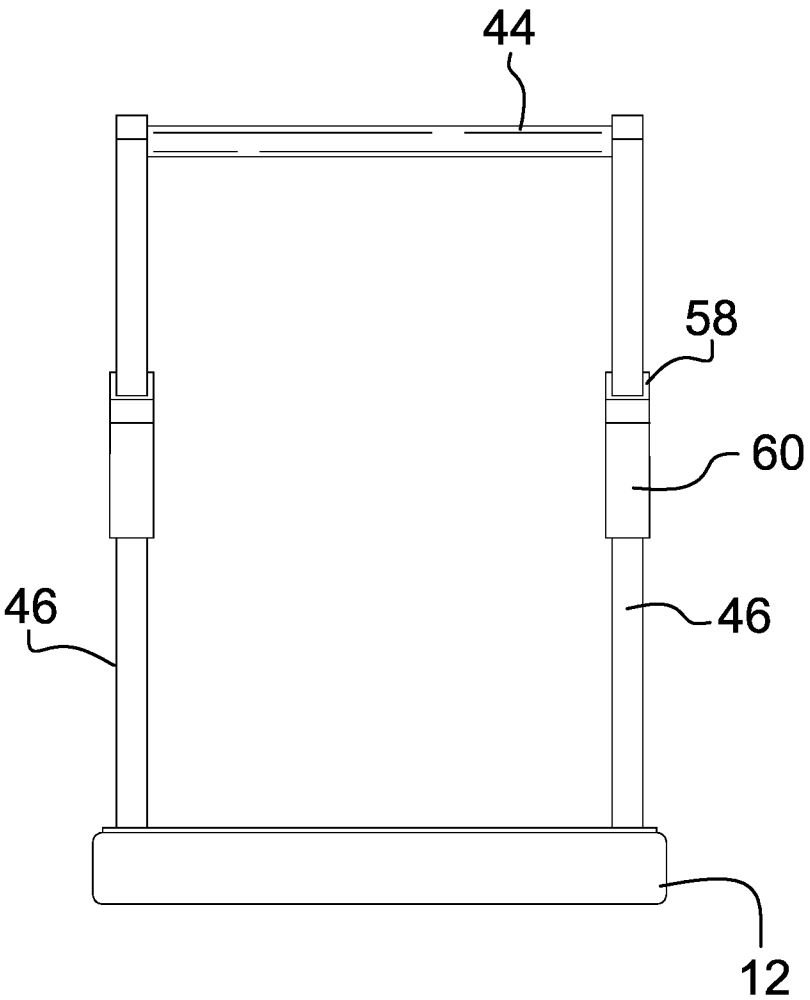
FIG. 2 is a front view of an embodiment of the disclosure.
Figure 4:
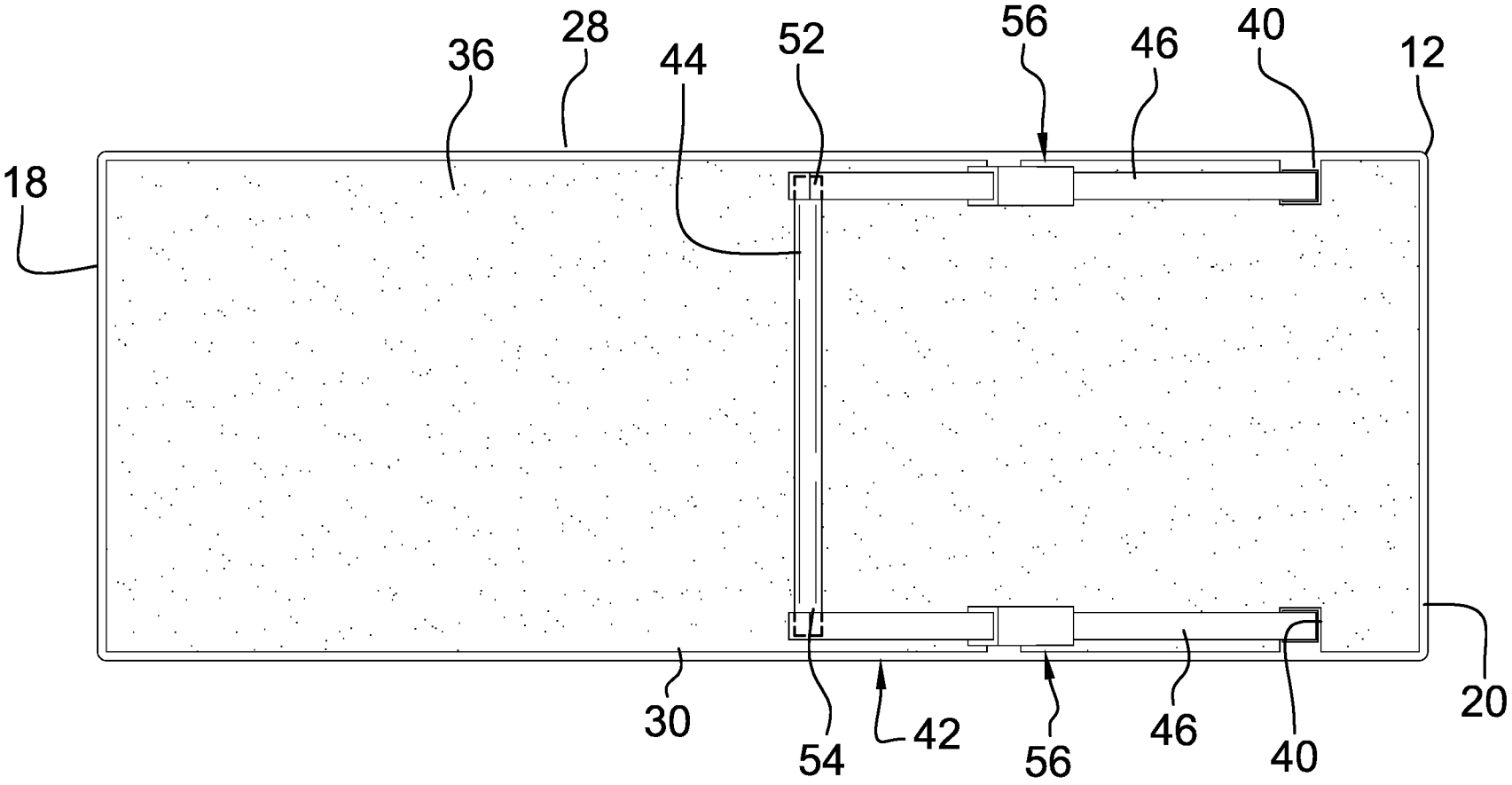
FIG. 4 is a top view of an embodiment of the disclosure.
Figure 5:
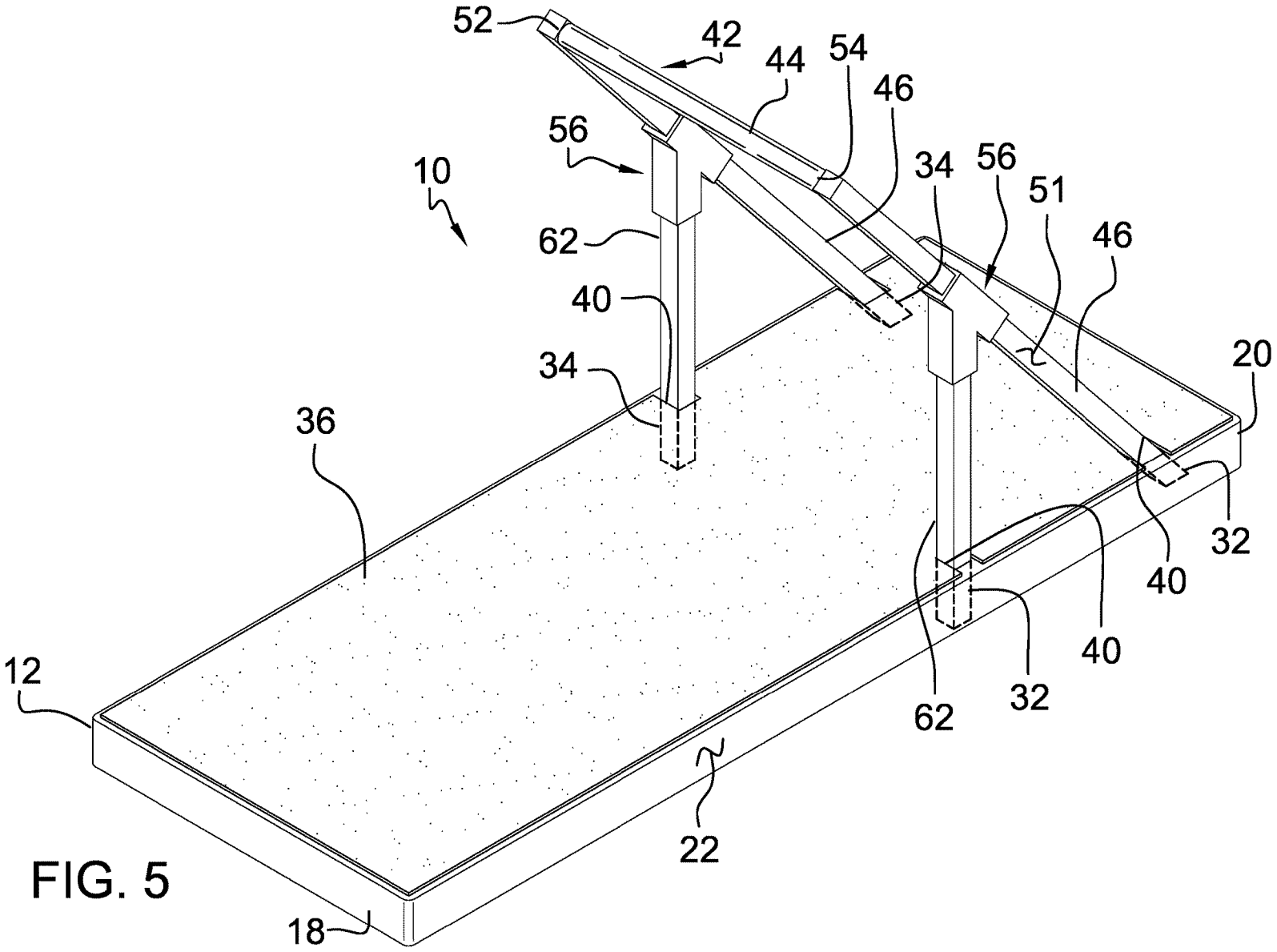
FIG. 5 is a top perspective view of an embodiment of the disclosure.
Figure 6:
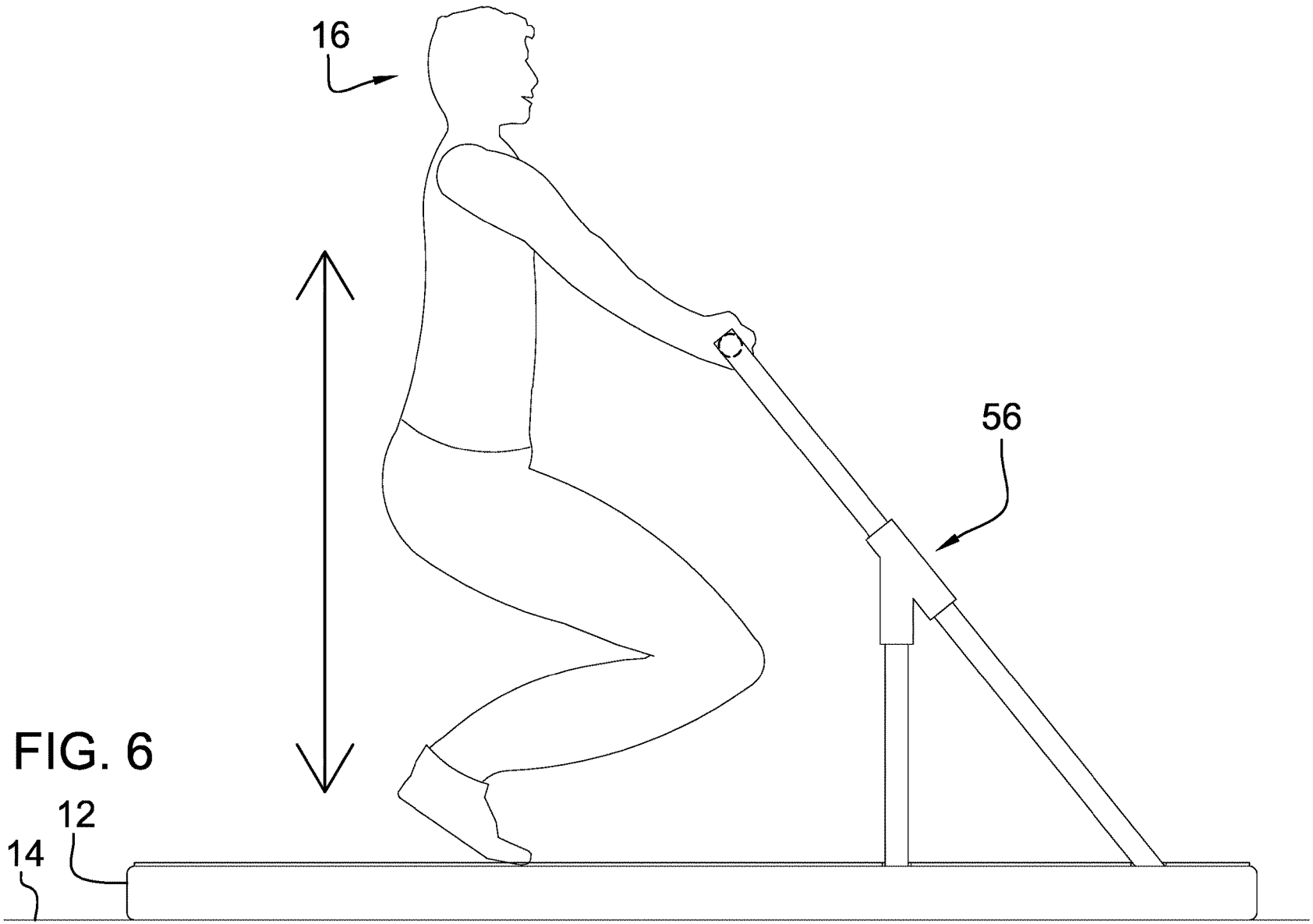
FIG. 6 is a perspective in-use view of an embodiment of the disclosure showing a user performing assisted squats.
Figure 7:
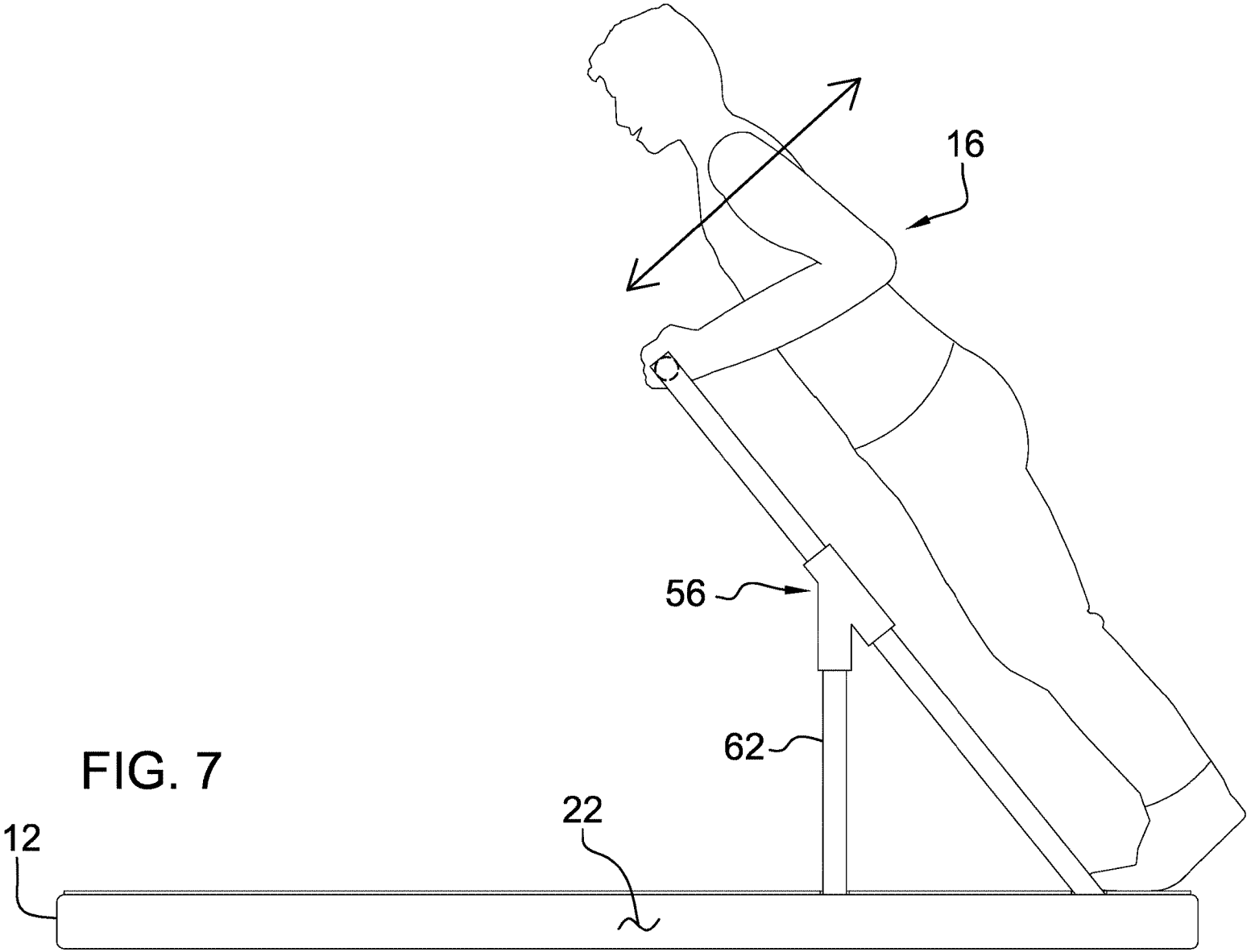
FIG. 7 is a perspective in-use view of an embodiment of the disclosure showing a user performing assisted push-ups.

With reference now to the drawings, and in particular to FIGS. 1 through 7 thereof, a new therapy device embodying the principles and concepts of an embodiment of the disclosure and generally designated by the reference numeral 10 will be described.

As best illustrated in FIGS. 1 through 7, the physical therapy assembly 10 generally comprises a platform 12 that is positionable on a horizontal support surface 14 thereby facilitating a user 16 to stand on the platform 12. The platform 12 has a first end 18, a second end 20 and an outer surface 22 extending between the first end 18 and the second end 20, and the outer surface 22 has a top side 24, a bottom side 26, a first lateral side 28 and a second lateral side 30. The platform 12 is elongated between the first end 18 and the second end 20, and the bottom side 26 lies on the horizontal support surface 14. The horizontal support surface 14 may be a floor or other surface upon which the user 16 might walk.

The top side 24 has a set of first wells 32 each extending toward the bottom side 26 and each of the first wells 32 is positioned adjacent to the first lateral side 28. The first wells 32 are spaced apart from each other and are distributed from a point located adjacent to the second end 20 toward the first end 18. Furthermore, the first well 32 that is located adjacent to the second end 20 is oriented to angle toward the second end 20 between the top side 24 and the bottom side 26. The top side 24 has a set of second wells 34 each extending toward the bottom side 26 and each of the second wells 34 is positioned adjacent to the second lateral side 30. The second wells 34 are spaced apart from each other and are distributed from a point located adjacent to the second end 20 toward the first end 18. The second well 34 that is located adjacent to the second end 20 is oriented to angle toward the second end 20 between the top side 24 and the bottom side 26.

A mat 36 is coupled to the platform 12 such that the user 16 stands on the mat 36. The mat 36 is comprised of a resiliently compressible material such that the mat 36 enhances comfort for the user 16 when the user 16 stands on the mat 36. The mat 36 has a lower surface 38 and the lower surface 38 is attached to the top side 24 of the outer surface 22 of the platform 12. The mat 36 has a plurality of cutouts 40 and each of the cutouts 40 is aligned with a respective one of the first wells 32 and the second wells 34 in the top side 24 of the outer surface 22 of the platform 12 such that the first wells 32 and the second wells 34 are exposed.

A support bracket 42 is removably attachable to the platform 12 and the support bracket 42 has a grip 44 that is integrated into the support bracket 42. The support bracket 42 extends upwardly from the platform 12 having the grip 44 being spaced from the platform 12 thereby facilitating the grip 44 to be gripped by the user 16 when the user 16 stands on the mat 36. The support bracket 42 is oriented to angle rearwardly on the platform 12 thereby facilitating the user 16 to perform assisted squats when the user 16 grips the grip 44. In this way the support bracket 42 can facilitate the user 16 to perform physical therapy exercises.

The support bracket 42 includes a pair of members 46 that each has an upper end 48, a lower end 50 and an outer surface 51 extending between the upper end 48 and the lower end 50. The grip 44 has a primary end 52 and a secondary end 54, and each of the primary end 52 and the secondary end 54 is coupled to the outer surface 51 of a respective one of the members 46 having the grip 44 being aligned with the upper end 48 of the members 46. The lower end 50 of each of the members 46 is insertable into a respective one of the second wells 34. A pair of couplers 56 is provided and each of the couplers 56 comprises a first tube 58 and a second tube 60 angling away from the first tube 58. Each of the members 46 of the support bracket 42 extends through the first tube 58 of a respective of the couplers 56 and the second tube 60 is directed downwardly from the first tube 58 when the members 46 are inserted into the respective second well. Additionally, each of the couplers 56 is positioned between the lower end 50 and the upper end 48 of the members 46.

A pair of uprights 62 is provided and each of the uprights 62 has a top end 64 and a bottom end 66. The bottom end 66 of each of the uprights 62 is insertable into a respective one of the first wells 32. Additionally, the top end 64 of each of the uprights 62 is insertable into the second tube 60 of a respective one of the couplers 56 when the members 46 of the support bracket 42 are inserted into the second wells 34. In this way the members 46 are retained in an angled orientation thereby facilitating the grip 44 to support the user's 16 weight when the user 16 grips the grip 44.

In use, the user 16 stands on the platform 12 and the user 16 grips the grip 44 on the support bracket 42 to perform assisted body squats. Additionally, the user 16 is positioned on the platform 12 such that the user 16 faces the second end 20 of the platform 12. In this way the user 16 can perform physical therapy exercises during rehabilitation from surgery, for example, without assistance. As is most clearly shown in FIG. 7, the user 16 can stand between the grip 44 and the second end 20 of platform 12 having the user 16 facing the first end 18 of the platform 12. Thus, the user 16 can grip the grip 44 to perform assisted pushups for physical therapy.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A physical therapy assembly for facilitating a user to perform assisted squats or assisted pushups, said assembly comprising:

a platform being positionable on a horizontal support surface thereby facilitating the user to stand on said platform;

a mat being coupled to said platform such that the user stands on said mat, said mat being comprised of a resiliently compressible material such that said mat enhances comfort for the user when the user stands on said mat; and a support bracket being removably attachable to said platform, said support bracket having a grip being integrated into said support bracket, support bracket extending upwardly from said platform having said grip being spaced from said platform thereby facilitating said grip to be gripped by the user when the user stands on said mat, said support bracket being oriented to angle rearwardly on said platform thereby facilitating the user to perform assisted squats when the user grips said grip wherein said support bracket is configured to facilitate the user to perform physical therapy exercises;

said platform has a first end, a second end and an outer surface extending between said first end and said second end, said outer surface having a top side, a bottom side, a first lateral side and a second lateral side, said platform being elongated between said first end and said second end, said bottom side lying on the horizontal support surface;

said top side has a set of first wells each extending toward said bottom side, each of said first wells being positioned adjacent to said first lateral side, said first wells being spaced apart from each other and being distributed from a point located adjacent to said second end toward said first end, said first well that is located adjacent to said second end being oriented to angle toward said second end between said top side and said bottom side;

said top side has a set of second wells each extending toward said bottom side, each of said second wells being positioned adjacent to said second lateral side, said second wells being spaced apart from each other and being distributed from a second point located adjacent to said second end toward said first end, said second well that is located adjacent to said second end being oriented to angle toward said second end between said top side and said bottom side;

said support bracket includes a pair of members each having an upper end, a lower end and an outer surface extending between said upper end and said lower end, said grip having a primary end and a secondary end, said primary end and said secondary end each being coupled to said outer surface of a respective one of said members having said grip being aligned with said upper end of said members, said lower end of each of said members being insertable into a respective one of said first wells and second wells; and a pair of couplers, each of said couplers comprising a first tube and a second tube angling away from said first tube, each of said members of said support bracket extending through said first tube of a respective of said couplers, said second tube being directed downwardly from said first tube when said members are inserted into said respective one of said first wells and second wells, each of said couplers being positioned between said lower end and said upper end of said members.

2. The assembly according to claim 1, wherein said mat has a lower surface, said lower surface being attached to said top side of said outer surface of said platform, said mat having a plurality of cutouts, each of said cutouts being aligned with a respective one of said first wells and said second wells in said top side of said outer surface of said platform such that said first wells and said second wells are exposed.

3. The assembly according to claim 1, further comprising a pair of uprights, each of said uprights having a top end and a bottom end, said bottom end of each of said uprights being insertable into a respective other one of said first wells and second wells, said top end of each of said uprights being insertable into said second tube of a respective one of said couplers when said members of said support bracket are inserted into said respective one of said first wells and second wells, such that said members are retained in an angled orientation thereby facilitating said grip to support a user's weight when the user grips said grip.

4. A physical therapy assembly for facilitating a user to perform assisted squats or assisted pushups, said assembly comprising:

a platform being positionable on a horizontal support surface thereby facilitating the user to stand on said platform, said platform having a first end, a second end and an outer surface extending between said first end and said second end, said outer surface having a top side, a bottom side, a first lateral side and a second lateral side, said platform being elongated between said first end and said second end, said bottom side lying on the horizontal support surface, said top side having a set of first wells each extending toward said bottom side, each of said first wells being positioned adjacent to said first lateral side, said first wells being spaced apart from each other and being distributed from a point located adjacent to said second end toward said first end, said first well that is located adjacent to said second end being oriented to angle toward said second end between said top side and said bottom side, said top side having a set of second wells each extending toward said bottom side, each of said second wells being positioned adjacent to said second lateral side, said second wells being spaced apart from each other and being distributed from a second point located adjacent to said second end toward said first end, said second well that is located adjacent to said second end being oriented to angle toward said second end between said top side and said bottom side;

a mat being coupled to said platform such that the user stands on said mat, said mat being comprised of a resiliently compressible material such that said mat enhances comfort for the user when the user stands on said mat, said mat having a lower surface, said lower surface being attached to said top side of said outer surface of said platform, said mat having a plurality of cutouts, each of said cutouts being aligned with a respective one of said first wells and said second wells in said top side of said outer surface of said platform such that said first wells and said second wells are exposed;

a support bracket being removably attachable to said platform, said support bracket having a grip being integrated into said support bracket, support bracket extending upwardly from said platform having said grip being spaced from said platform thereby facilitating said grip to be gripped by the user when the user stands on said mat, said support bracket being oriented to angle rearwardly on said platform thereby facilitating the user to perform assisted squats when the user grips said grip wherein said support bracket is configured to facilitate the user to perform physical therapy exercises, said support bracket including a pair of members each having an upper end, a lower end and an outer surface extending between said upper end and said lower end, said grip having a primary end and a secondary end, said primary end and second end each, being coupled to said outer surface of a respective one of said members having said grip being aligned with said upper end of said members, said lower end of each of said members being insertable into a respective one of said first wells and second wells;

a pair of couplers, each of said couplers comprising a first tube and a second tube angling away from said first tube, each of said members of said support bracket extending through said first tube of a respective of said couplers, said second tube being directed downwardly from said first tube when said members are inserted into said respective one of said first wells and second wells, each of said couplers being positioned between said lower end and said upper end of said members; and a pair of uprights, each of said uprights having a top end and a bottom end, said bottom end of each of said uprights being insertable into a respective other one of said first wells and second wells, said top end of each of said uprights being insertable into said second tube of a respective one of said couplers when said members of said support bracket are inserted into said respective one of said first wells and second wells such that said members are retained in an angled orientation thereby facilitating said grip to support a user's weight when the user grips said grip.

* * * * *